US010987728B2

(12) United States Patent
Spatz et al.

(10) Patent No.: US 10,987,728 B2
(45) Date of Patent: Apr. 27, 2021

(54) APPARATUS AND METHOD OF MANUFACTURING METALLIC OR INORGANIC STRANDS HAVING A THICKNESS IN THE MICRON RANGE BY MELT SPINNING

(71) Applicant: MAX-PLANCK-GESELLSCHAFT ZUR FÖRDERUNG DER WISSENSCHAFTEN E.V., Munich (DE)

(72) Inventors: Joachim P. Spatz, Stuttgart (DE); Moyu Watari, Stuttgart (DE); Reinhard Mager, Magstadt (DE)

(73) Assignee: Max-Planck-Gesellschaft zur Förderung der Wissenschaften e.V.

( * ) Notice: Subject to any disclaimer, the term of this patent is extended or adjusted under 35 U.S.C. 154(b) by 863 days.

(21) Appl. No.: 15/321,479

(22) PCT Filed: Aug. 6, 2015

(86) PCT No.: PCT/EP2015/068194
§ 371 (c)(1),
(2) Date: Dec. 22, 2016

(87) PCT Pub. No.: WO2016/020493
PCT Pub. Date: Feb. 11, 2016

(65) Prior Publication Data

US 2017/0209918 A1 Jul. 27, 2017

(30) Foreign Application Priority Data

Aug. 7, 2014 (EP) ..... 14180273

(51) Int. Cl.
*B22D 11/06* (2006.01)
*B22D 11/00* (2006.01)

(52) U.S. Cl.
CPC ..... *B22D 11/0611* (2013.01); *B22D 11/005* (2013.01); *B22D 11/0651* (2013.01)

(58) Field of Classification Search
CPC ..... B22D 11/0611; B22D 11/0651; B22D 11/005
See application file for complete search history.

(56) References Cited

U.S. PATENT DOCUMENTS 2,825,108 A 3/1958 Pond
2,825,198 A 3/1958 Krahschutz
(Continued)

FOREIGN PATENT DOCUMENTS

DE 3443620 A 6/1985
EP 0227837 A1 7/1987
(Continued)

OTHER PUBLICATIONS

Office Action from the Patent Office in Japan for related Japanese Application No. 2016-575664; 8 pages.
(Continued)

*Primary Examiner* — Kevin P Kerns
*Assistant Examiner* — Steven S Ha
(74) *Attorney, Agent, or Firm* — Dickinson Wright PLLC

(57) ABSTRACT

Apparatus for producing elongate strands of metal comprises a rotatable wheel having a circumferential surface, at least one nozzle for directing a molten metal onto the circumferential surface and a collection means for collecting solidified strands of metal formed. The solidified strands are formed on the circumferential surface from the molten metal and are separated from the circumferential surface by centrifugal force generated by rotation of the wheel. The circumferential surface has a circumferentially extending structure having circumferentially extending edges and recesses formed between or bounded by the edges, and by an
(Continued)

Figure 1:
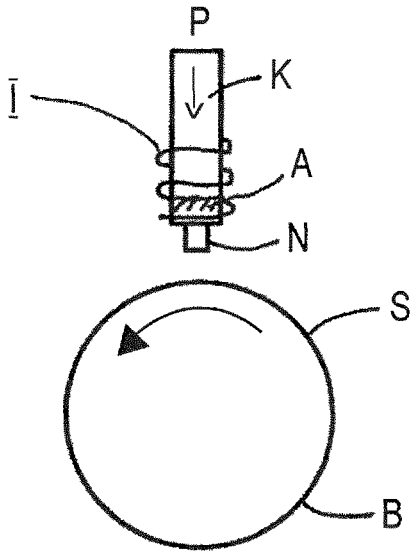

apparatus for controlling a gas pressure applied to the liquid metal which moves the liquid metal through the nozzle opening and delivers it to the circumferential surface of the rotatable wheel. The nozzle has a rectangular cross-section with a width of the nozzle opening in the circumferential direction of rotation of the wheel and a length transverse to the circumferential surface of the wheel which is greater than the width. A method and a wheel adapted for use in the apparatus are also claimed.

17 Claims, 15 Drawing Sheets

(56) References Cited

U.S. PATENT DOCUMENTS

| | | | | |
|---|---|---|---|---|
| 2,910,724 | A | 11/1959 | Grajeck | |
| 2,910,744 | A | 11/1959 | Pond | |
| 2,976,590 | A | 3/1961 | Pond | |
| 4,221,257 | A * | 9/1980 | Narasimhan | B22D 11/005 164/429 |
| 4,523,966 | A * | 6/1985 | Tsuya | C30B 11/00 438/490 |
| 4,719,964 | A | 1/1988 | Sato et al. | |
| RE33,327 | E | 9/1990 | Hackman et al. | |
| 5,096,513 | A * | 3/1992 | Sawa | B22D 11/0611 148/304 |
| 6,622,777 | B2 | 9/2003 | Park | |
| 6,626,228 | B1 * | 9/2003 | Bewlay | B22D 11/0611 164/463 |
| 2002/0020514 | A1 * | 2/2002 | Arai | H01F 1/0551 164/463 |

FOREIGN PATENT DOCUMENTS

| | | | | |
|---|---|---|---|---|
| EP | 1146524 | A1 | 10/2001 | |
| JP | 61096046 | A | 5/1986 | |
| JP | 06346116 | A | 12/1994 | |
| JP | H09271909 | A | 10/1997 | |
| JP | 10180422 | A | 7/1998 | |
| JP | 2002059246 | A | 2/2002 | |
| WO | WO-8702284 | A1 * | 4/1987 | B22D 11/0651 |

OTHER PUBLICATIONS

Egami, T. , "Magnetic amorphous alloys: physics and technological applications", Reports on Progress in Physics, Mar. 1984, vol. 47 , pp. 1601-1725, Univeristy of Pennsylvania, Philadelphia, PA.

International Preliminary Report on Patentability for PCT/EP2015/068194 dated Feb. 7, 2017, 9 pages.

International Search Report for PCT/EP2015/068194 dated Oct. 20, 2015, 4 pages.

Kheshgi, Haroon S. and Scriven, L.E., "Dewetting: Nucleation and Growth of Dry Regions", Chemical Engineering Science, 1991, vol. 46, No. 2, pp. 519-526, University of Minnesota, Minneapolis, MN:

Liebermann, H. and Graham, C., "Production of Amorphous Alloy Ribbons and Effects of Apparatus Parameters on Ribbon Dimensions", IEE Transactions on Magnetics, Nov. 1976, pp. 921-923, vol. 12, No. 6, University of Pennsylvania, Philadelphia, PA.

Ruckenstein, Eli and Jain, Rakesh K., "Spontaneous Rupture of Thin Liquid Films", Journal of the Chemical Society, Faraday Transactions II, 1974, vol. 70, pp. 132-147, University of Delaware, Newark, Delaware.

Written Opinion for PCT/EP2015/068194 dated Oct. 20, 2015, 8 pages.

* cited by examiner

| Experiment | Wheel Profile and scale bar size | Slit width (μm) | Wheel Rotation (Hz) | Median (μm) | Std. Dev. μm | Max (μm) | Min (μm) | ΔP (mbar) |
|---|---|---|---|---|---|---|---|---|
| MS03 |  Scale bar 1mm | 400 | 30 | textured ribbons | | | | 200 |
| MS23 |  Scale bar 1mm | 400 | 85 | | | | | 200 |
| MS34 |  Scale bar 1mm | 100 | 85 | 22.6 | 34.2 | 171.2 | 10.4 | 400 |
| MS31 |  Scale bar 250 μm | 100 | 85 | 22.8 | 21.3 | 146.2 | 8.4 | 400 |
| MS37 |  Scale bar 1mm | 50 | 85 | 16.6 | 9.2 | 48.4 | 9.3 | 1000 |
| MS33 |  Scale bar 250 μm | 100 | 85 | 7.5 | 11.8 | 75.1 | 2.8 | 400 |
| MS58 |  Scale bar 250 μm | 75 | 95 | 22 | 31.6 | 144 | 2.3 | 800 |

MS003

MS023

MS034
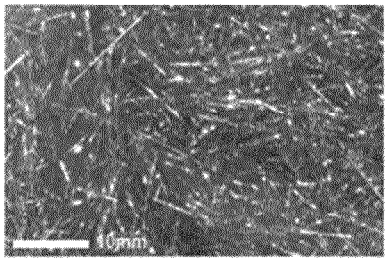
Fig. 20
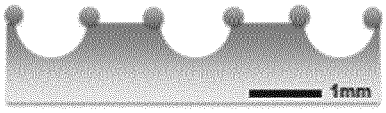
MS031
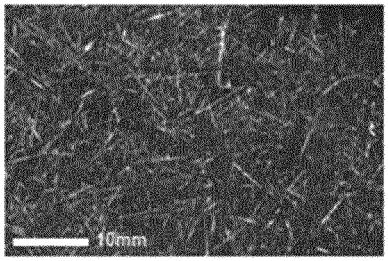
Fig. 21
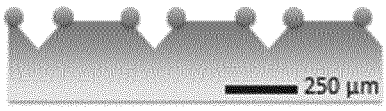

MS037

MS033

APPARATUS AND METHOD OF MANUFACTURING METALLIC OR INORGANIC STRANDS HAVING A THICKNESS IN THE MICRON RANGE BY MELT SPINNING

CROSS-REFERENCES TO RELATED APPLICATIONS

This patent application is a 371 of International Application No. PCT/EP2015/068194, filed Aug. 6, 2015 which claims the priority of European Application No. 14180273.6 filed Aug. 7, 2014, both of which are incorporated herein by reference in their entirety.

Melt spinning is a technique used for the rapid cooling of liquids. A wheel may be cooled internally, usually by water or liquid nitrogen, and rotated. A thin stream of liquid is then dripped onto the wheel and cooled, causing rapid solidification. This technique is used to develop materials that require extremely high cooling rates in order to form elongate fibres of materials such as metals or metallic glasses. The cooling rates achievable by melt-spinning are of the order of $10^4$-$10^7$ kelvin per second (K/s).

The first proposals for melt spinning originated with Robert Pond in a series of related patents from 1958-1961 (U.S. Pat. Nos. 2,825,108, 2,910,744, and 2,976,590). In U.S. Pat. Nos. 2,825,198 and 2,910,724 a molten metal is ejected through a nozzle under pressure onto a rotating smooth concave surface of a chill block. By varying the surface speed of the chill block and the ejection conditions it is said to be possible to form metal filaments with a minimum cross sectional dimension of 1 μm to 4 μm and lengths from 1 μm to infinity. In U.S. Pat. No. 2,824,198 a single chill block is used, in U.S. Pat. No. 2,910,724 a plurality of nozzles direct flows of metal onto one rotating chill block or a plurality of rotating chill blocks and associated nozzles are provided. In U.S. Pat. No. 2,910,724 no chill block is provided instead the molten metal is ejected downwardly through nozzles into a vertically disposed cooled chamber containing solid carbon dioxide on ledges provided at the side wall of the chamber. By varying the cross sectional shape of the nozzles the cross-sectional shape of the filaments produced can be varied.

The current concept of the melt spinner was outlined by Pond and Maddin in 1969. Although, liquid was, at first, quenched on the inner surface of a drum. Liebermann and Graham further developed the process as a continuous casting technique by 1976, this time on the drum's outer surface.

The process can continuously produce thin ribbons of material, with sheets several inches in width being commercially available.

References to this process can be found in the following publications:

1. R. W. Cahn, Physical Metallurgy, Third edition, Elsevier Science Publishers B.V., 1983.
2. Liebermann, H.; Graham, C. (November 1976). "Production of amorphous alloy ribbons and effects of apparatus parameters on ribbon dimensions". IEEE Transactions on Magnetics 12(6): 921-923. doi: 10.1 I09/TMAG.1976.1059201.
3. Egami, T. (December 1984). "Magnetic amorphous alloys: physics and technological applications". Reports on Progress in Physics 47 (12): 1601.doi: 10.1088/0034-4885/47/12/002.

The melt spinning process has hitherto not been used for the commercial manufacture of micron scale metallic ribbons and fibres on an industrial scale.

In this connection it should be noted that a fibre can be understood as an element of which the length is at least twice its width.

Metal fibre reinforced composite materials play a central role in a whole series of applications for the improvement of the most divers properties. Examples of such applications are:

- Electrodes for batteries and accumulators,
- Conductive plastics for touch sensitive systems such as displays and artificial hands in the field of robots,
- Anti-electrostatic textiles and plastics,
- Mechanically reinforced textiles, plastics and cement for lightweight and heavy construction,
- Filter materials for use in environments subjected to mechanical and/or chemical stress
- Catalysis An important aspect for the improvement of fibre based material functions is a large surface area to weight ratio of the meta fibres and the ability to manufacture and process them in an industrially relevant process. This signifies:

- low densities and adjustable lengths of the metal fibres,
- control of the fibre adhesion for the further processing of the fibres,
- economic manufacturing method and low process costs with a high material yield per unit time, Nowadays, the industrially relevant manufacture of functional materials based on metal fibres is restricted to fiber thicknesses of >50 μm. Academic processes exist based on lithographic techniques, glass based template methods and mechanical extrusion process which enable metallic fibres of <50 μm to be achieved. These methods cannot however be utilized industrially because they are restricted to a few materials and in some cases are not repeatable.

The invention described here permits the manufacture of metallic fibres having a width and thickness significantly less than 1 mm, ideally in the range between 1 and 100 μm and an aspect ratio of length to width of greater than 2:1, ideally greater than 10 to 1. Metallic fibres of a size greater than 50 μm are normally produced industrially by a drawing, rolling or extrusion process. Wires with diameters under 50 μm are normally manufactured individually by a mechanically complicated drawing process from a wire of larger diameter to a smaller diameter.

Smaller diameters have hitherto not been realized on a large scale technically by precipitation from the melt. The reason is to be found in the normally very high surface energy and very low viscosity of metallic melts.

The high surface energy and the low viscosity of metallic wires results in a constriction of a metallic jet and the formation of droplets. The wetting of a capillary likewise makes the "spraying" of wires of small diameter difficult as a result of the large capillary forces. Mathematically the droplet formation is described by the Young-Laplace equation.

In contrast to metallic melts, polymer melts can be spun industrially to a diameter of a few tens of nanometers and an aspect ratio of several thousand as a result of the lower surface energy and the significantly higher viscosity of the polymer melt.

The present invention describes an apparatus and a method which enables the manufacture of metallic strands with a width and thickness smaller than 50 μm by a melt spinning method by exploiting the properties of metallic melts, i.e. high surface energy and low viscosity. One particular object of the present invention is to provide a method and an apparatus for manufacturing metal strands which results in a high yield of desired fibres (strands) having a relatively tight distribution of lengths, widths and thicknesses so that a relatively homogenous product is achieved.

In order to satisfy this object there is provided, in accordance with the present invention, an apparatus for producing elongate strands of metal, the apparatus comprising a rotatable wheel having a circumferential surface, the circumferential surface having circumferentially extending edges and recesses formed between or bounded by the edges, at least one nozzle having a nozzle opening for directing a molten metal onto the circumferential surface and a collection means for collecting solidified strands of metal formed on the circumferential surface from the molten metal and separated from the circumferential surface by centrifugal force generated by rotation of the wheel, the apparatus being characterized in that the nozzle (N) has a rectangular cross-section having a width (W) of the nozzle opening in the circumferential direction (C) of rotation of the wheel (B) and a length transverse to the circumferential surface of the wheel which is greater than the width W, and in that an apparatus is provided for controlling a gas pressure applied to the liquid metal which moves the liquid metal through the nozzle opening and delivers it to the circumferential surface of the rotatable wheel.

Also according to the present invention there is provided a wheel having a structured circumferential surface with circumferentially extending edges and recesses formed between or bounded by the edges and adapted for use in the above recited apparatus. The present invention also relates to a method A method for producing elongate strands of metal optionally having at least one transverse dimension of 50 μm or less and a length at least ten times greater than said at least one transverse dimension, the method comprising the steps of directing a molten metal through a nozzle having a rectangular cross-section with a width of the nozzle opening in the circumferential direction of rotation of the wheel and a length transverse to the circumferential surface of the wheel which is greater than the width onto the circumferential surface of a rotating wheel, by applying a gas pressure to the liquid metal to move it through the nozzle opening and deliver it to the circumferential surface of the rotatable wheel, providing the circumferential surface of the rotatable wheel with circumferentially extending edges and recesses formed between or bounded by the edges and collecting solidified strands of metal formed on the circumferential surface from the molten metal and separated from the circumferential surface by centrifugal force generated by rotation of the wheel, the method further comprising the steps of controlling the width of the nozzle opening, controlling the a gas pressure applied to the liquid metal to move it through the nozzle opening and deliver it to the circumferential surface of the rotatable wheel and controlling the speed of rotation of the wheel to reduce the flow of molten metal onto the circumferential surface of the wheel per unit of time, in a metal dependent manner, to a level at which it is concentrated by the forces that are acting at the said circumferentially extending edges formed between or bounded by the edges and using these edges to concentrate the molten metal at the edges produce the desired elongate strands of metal.

The present invention is thus based on the recognition that the high surface energy of a molten metal brings about a strong capillary effect at boundary surfaces and in particular at edges or corners of substrates, for example in corners wetted by metallic melts. The structuring of the circumferential surface of the rotating wheel leads to such edges and recesses and the capillary forces thus favor the concentration of the molten metal along such edges and recesses which results in the widths and thicknesses of the strands being constrained to lie within relatively close limits so that a uniform product is achieved. Moreover, the uniformity of the thickness and width of the metal strands means that the length of strand produced prior to separation form the wheel and from the following strand due to the action of centrifugal force is also more uniform, which is again more favorable for the production of a uniform metal strand product.

Using the above apparatus and method it has proved possible in laboratory experiments to manufacture metallic microfibers (strands or ribbons) with a width of <10 μm (median) directly from a metallic melt of Al, Zinc, Pb, stainless steel or $Fe_{40}Ni_{40}B_{20}$ by means of an industrially relevant melt spinning process as will be described later in more detail with reference to the specific description of the figures. In this way the surface area to weight ratio of these microfibers is already 400 times better than the previous industrially utilised metal fibres! The manufacture of metallic fibres with widths and thicknesses <1 μm is considered practical.

The physical principle of this metal fibre production process is based on the separation of a metal melt in thin films on a solid substrate. In theory two possible mechanisms have been discussed for the breaking up of a liquid film on a solid substrate:

(i) The heterogenous nucleation of holes as a result of defects in liquid films H. S. Kheshgi and L. E. Scriven, Chem. Eng. Sci. 46, 519 (1991). These defects can, for example, be provoked by topographies in the substrate and organized laterally to the substrate surface.

(ii) The spontaneous breaking up of a liquid film under the influence of long range forces, known as spinodal dewetting (see E. Ruckenstein and R. K. Jain, J. Chem. Soc. Faraday Trans. II 70, 132 (1974).

In the method proposed here both mechanisms are exploited. In this connection use is made of the established process of melt spinning. Traditionally amorphous metals in the form of macroscopic bands are produced. In the present invention the melt spinning process is modified in the following ways:

- the nozzle geometry is especially selected to reduce and control the quantity of molten metal falling onto the circumferential surface of the rotating wheel per unit axial width of the circumferential surface,
- significantly higher speed of rotation of the wheel,
- structuring of the wheel along the wheel surface perpendicular to the axis of rotation with a groove structure.

The surface topography of the wheel, the forces which arise due to surface tension and in particular the high centrifugal forces bring about the control of the de-wetting laterally of the wheel surface and perpendicular to the axis of rotation. Different process parameters result in different thicknesses and thickness distributions of the metal fibres. In this connection the reduction of the deposition rate of the metallic melt onto the wheel by a smaller nozzle width, by an appropriate applied pressure to expel the metal melt from the crucible and an increase in the peed of rotation of the wheel lead to a significant reduction of the fibre thickness.

The width of the nozzle opening can lie in the range from 1 mm to 10 μm, preferably in the range from 400 μm to 10 μm especially 200 μm to 10 μm and most preferably from 100 μm to 10 μm. The smaller the outlet width of the nozzle the finer are the fibres produced.

The circumferential recesses defining the edges have a radial depth greater than 50 μm and preferably in the range from 50 μm to 1000 μm.

The circumferential recesses defining the edges have a width in the range from 1000 μm to 50 μm and especially in the range from 1000 μm to 100 μm. Most preferred is when the wheel has a profile with a structure size greater than 100 μm, i.e. the depth of the grooves, the width of the grooves and the width of any lands between the grooves should all be greater than 100 μm.

At this point reference should also be made to EP-A-1 146 524 and Japanese patent application JP-A-09271909. EP-A-1 146 524 is directed to the manufacture of magnetic ribbon by the melt spin process. For good magnetic material oxidation must be prevented. For this reason the process is operated under inert gas. This inert gas disturbs the process of making uniform layer thicknesses, which are in turn important for the magnetic properties of the material. It is important to note that EP-A-1 146 524 discloses a nozzle with a circular orifice. The EP document utilizes a technique by which the gas is directed away from the ribbon on the roll. For this purpose grooves are provided on the wheel. The generally circumferential grooves have an average depth in the range 0.5 to 20 μm and an average pitch of 0.5 to 100 μm. The ribbons produced have average thicknesses between 8 and 50 μm and are clearly elongate because 5 cm samples are taken and subsequently milled to form magnetic powder. No real information is given on the width of the ribbons. JP-A-09271909 discloses a similar concept for removing air from the forming ribbon, but here the grooves are arranged in chevron form (V form) on the surface of the wheel. So far as can be seen there is no discussion in either of these patent specifications that the ribbons should be constrained laterally (widthwise) nor any suggestion as to how this can be done. In both documents (JP-A-09271909 and EP-A-1 146 524) the inventors are concerned with recesses in the surface of the wheel to lead gas away from the wheel surface and the metal and to increase the contact area between the wheel surface and the metal (EP-A-1 146 524 [0043-0044, 0046] and JP-A-09271909 [0003]). EP-A-1 146 524 explicitly states that the grooves should have a depth of 0.5 to 20 μm, more preferably 1 to 10 μm, and that if the depth of the groove is increased huge dimples result. This is a clear indication to the person skilled in the art that he should not increase the groove depth beyond the value quoted.

In contrast to the production of relatively wide ribbons the present invention is concerned with narrow fibres having relatively accurately and uniformly reproducible thicknesses and width, the thicknesses and widths of at least a high proportion of the fibres each lying in the range between 50 and 1 μm. That this can be achieved can be seen from the median values and the standard deviation values entered in FIG. 17

Neither EP-A-1 146 524 nor JP-A-09271909 describes a lateral restriction of the ribbons produced there. Neither reference suggests that recesses could be exploited to generate a lateral constriction of the ribbons, so that fibres are formed. Both references show relatively wide ribbons with a width much greater than their thickness, see EP-A-1 146 524, FIG. 1 and JP-A-09271909, FIG. 2*a*).

EP-A-1 146 524 admittedly gives no accurate value for the width of the ribbons, however one can conclude from FIGS. 1 and [0098] that the ribbons are very much wider than they are thick. As the thickness of the ribbons lies between 8 and 50 μm, the reference contains no suggestion for the skilled person that he should produce lateral constriction of the ribbons in the preferred range of 3 to 25 μm. Furthermore, the FIGS. 12 and 15 of EP-A-1 146 524 show embodiments which are in no way suited for a lateral restriction of the ribbons. The apertured surface structure in FIG. 15 is described in paragraph [0155] in such a way that it functions just as well as the other structured surfaces shown in the EP document, which actually leads the person averagely skilled in the art away from providing circumferential grooves for the purpose of lateral constrainment.

JP-A-09271909 describes similar art to EP-A-1 146 524 and shows in FIG. 1*c* a W-shaped surface groove structure The JP document is concerned with the spacing between the recesses and states that this spacing should be as small as possible and at least smaller than 200 μm. Wider spacings allegedly lead to a poorer removal of the air and thus to a poorer result.

In both documents the manufacture of the powdery magnetic particles is based on a comminution process which follows the melt spinning process. This has nothing to do with the melt spinning process itself. It is a completely different application of the melt spinning process and the prior art references are simply not concerned with the preparation of fibres to which the present application is directed.

EP-A-0 227 837 describes the coiling of a wire which is created by extrusion through a nozzle in a melt spinning apparatus. The wheel is not structured and thus this reference is irrelevant for the claimed process:

The US reissue patent Re_33,327 relates to a special construction of the container from which molten metal is drawn by the rotatable wheel from the surface layer of the molten material in the container. I.e. the molten material is not dropped or ejected under pressure through an orifice onto the wheel (as is the case in the present invention), which is described as disadvantageous in the reissue reference. The grooves formed on the surface of the wheel are said to have a pitch in the range from 22 to 40 per inch corresponding to a groove pitch in the range from approximately 1100 μm to 630 μm.

The Liebermann reference "Liebermann h. h. et al Production of amorphous alloy ribbons and effects of apparatus parameters on ribbon dimensions XR002736061, November 1996" relates to the production of bands as opposed to fibres.

The structured circumferential surface of the wheel may also comprise peripherally (circumferentially) extending lands, each land being disposed between two circumferentially extending recesses. The presence of such lands forms a reservoir of melt material between the circumferentially extending edges and this material can be concentrated into the metal strands by the capillary action generated at the edges. Thus the presence of the lands and their width can be selected to influence the width of the metal strands that are produced. The lands typically have widths of 1 mm or less. The lands also provide surface area for additional heat removal from the molten metal and can thus also influence the size of the strands produced, since the size does not change after solidification has taken place.

The cross-sectional shape of the recesses does not appear to be critical. Thus the recesses can have a cross-sectional shape selected from the group comprising semi-circular, symmetrically v-shaped, asymmetrically v-shaped, rectangular and trapezoidal. The volume of the recesses is, however, another important criteria determining the width and thickness of the metal strands that are produced.

The metal strands typically have the form of ribbons having a thickness of 10 μm or less and a width of 200 μm or less.

Generally speaking the metal strands typically have at least one transverse dimension of 50 μm or less and a length at least ten times greater than said at least one transverse dimension.

For the sake of completeness reference should also be made to two further prior art documents:

DE3443620 describes a method of making a round wire by a melt spinning process. In that method the circumferential surface of a rotatable wheel is provided with a groove extending in the direction of rotation and a plurality of nozzles aligned in series along the groove are used to deposit molten metal into the groove as the wheel rotates. With a surface speed of 25 m/sec a wire of oval cross section with a major diameter of 1 mm and a minor diameter of 0.7 mm is produced and is subsequently drawn to a round wire of 0.5 mm diameter. This document does not disclose the function of utilizing the edges formed by the groove to separate a stream of molten metal into thin strands or ribbons of material by appropriate choice of the operating parameters such as the surface speed of the wheel.

U.S. Pat. No. 6,622,777 describes a way of making metal fibres by "dropping a metal plate vertically onto the blades of a rotary disc thereby extracting metal fibre therefrom". The metal plate passes through a pair of induction coils which has a melting function but there is no description of molten metal being dispensed onto the blades of the rotary disc. The structure and dimension of the blades are not indicated in the above mentioned patent. The authors of the reference use the blades for "cutting" metal out of a metal plate. The reference does not discuss the use of a nozzle of defined geometry which is an important feature of the present invention, nor does it discuss the use of a profiled circumferential surface having a defined structure or geometry, another important feature of the present invention. Also there is no discussion of the metal plate being completely melted. In contrast, the melting of the metal upstream of a nozzle is another important feature of the invention as it allows a controlled gas pressure to dispense the molten metal through a nozzle of defined geometry, which is not present in the reference. The nozzle geometry and amount of pressure applied to the liquid metal regulates (controls) the amount of liquid metal material which passes through the nozzle and hits the rotating wheel. This control is critical for obtaining small fibre width dimensions and controlling the geometry as well as the distribution of geometry dimensions (small distribution!) Certainly it is not clear that the referenced operates with liquid metal. Although the word "melt" is used it seems to be more important for the authors of the reference that a solid metal plate is in contact with the blade, although the end of the plate might be in a melted or softened state. The reference also does not disclose the inventive concept of separating the solid metal from the liquid metal.

The reference does not disclose the concept of dispensing a drop of molten metal and does not provide any way of controlling the volume of metal brought into contact with the rotating blade. There certainly does not seem to be any disclosure of the controlling of the amount of metal deposited on the blades. In addition there is no suggestion in the reference that edge effects be used to generate metal ribbons. Equally there is no disclosure of the use of appropriate wheel speeds to ensure the specific metal being used is separated into ribbons of the desired size. This is again an important element of the present invention, namely that the wheel speed is selected in dependence on the nozzle size, the gas pressure and the specific metal being converted into ribbons of the desired size The rotatable wheel is usefully temperature controlled and preferably cooled e.g. to a temperature in the range of −100° C. to +200° C. Controlling the temperature of the wheel permits the solidification rate of the molten material to be controlled and this again favors the manufacture of uniform metal strands.

The wheel is expediently made of a metal, for example copper or aluminium, or of a metal alloy or of a ceramic material or of carbon such as graphite. Also layers of one of these materials on a base wheel are possible such as carbon evaporated layers on a copper base wheel. Such materials have good thermal conductivity which again favors the solidification process.

If desired the structure of the circumferential surface of the wheel can be made by lithographic technique which can enable sharp structures of small dimensions to be made more easily than by milling or turning.

The wheel is conveniently mounted to rotate within a chamber having an atmosphere at a pressure corresponding to the ambient atmospheric pressure, or to a lower pressure than ambient pressure or to a higher pressure than ambient pressure. The atmosphere in the chamber affects the formation of the solidified metal strands and can be used to fine tune the geometry of the metal strands that are produced. For metals which react with the constituents of air it can be favorable to use an inert gas atmosphere in the chamber. Also, under some circumstances a reactive gas atmosphere could be beneficial, for example a nitrogen or carbon containing atmosphere could be used to nitride or carburize suitable steel materials if hardened metal strands are desired. A deflector such as a scraper blade or doctor blade can optionally be provided upstream of the nozzle in the direction of rotation of the wheel to deflect boundary air from the circumferentially extending surface prior to depositing molten metal on the surface via the nozzle. Such a deflector, which only needs to have a minimum spacing from the circumferential surface of the wheel to avoid damaging the structure thereof (and the function of which can also be provided by the nozzle if this is positioned close to the circumferential surface of the wheel), can prevent the boundary air carried along with the wheel from undesirably affecting the flow of molten metal from the nozzle onto the circumferential surface, for example thereby reducing cooling of the metal material prior to it reaching the surface of the wheel.

Generally speaking a gas pressure is applied to the molten metal to force it through the nozzle. Such a gas pressure is generally necessary because the high surface tension/energy of the molten metal will inhibit its flow through a small nozzle. The additional gas pressure (additional to the weight of the molten metal) causes the molten metal to flow through the nozzle. When reference is made here to the pressure applied to the molten metal the pressures recited will be understood to be the amount by which the pressure is higher than the pressure prevailing in the chamber of the apparatus, which is frequently kept below atmospheric pressure, e.g. at 400 mbar. The expression delta P or ΔP refers to the pressure difference between the pressure operating on the molten metal in the crucible and the internal pressure in the chamber.

The gas pressure is typically selected in the range from 50 mbar to 1 bar overpressure relative to the pressure external to the nozzle. The gas pressure regulates the deposition rate of molten metal onto the rotating wheel. This parameter controls the dimension of the metal ribbon as well.

The nozzle expediently has a rectangular cross-section having a width in the circumferential direction of rotation of the wheel of less than 1 mm. The length direction of the nozzle is oriented perpendicular to the direction of rotation of the circumferential surface of the wheel.

An electric motor is conveniently used to drive the wheel at a frequency up to 95 Hz for a wheel having a diameter of 200 mm, i.e. more generally at circumferential speeds of up to and above 60 m/s.

The circumferential surface of the wheel may have transversely extending features to control the length of the strands produced. Such features could for example comprise a number of transverse, regularly spaced, grooves interrupting the circumferentially extending edges and recesses at the circumferential surface of the wheel.

The material of the wheel is selected so that it does not readily bond to the molten metal, for example a wheel of copper can be used for Fe40Ni40B20 alloy, aluminum, or lead.

In the melt spinning process of the invention one applies the metallic melt through the opening of a crucible onto a very quickly rotating metallic wheel. The wheel normally consists of copper and can be well cooled. In particular one can exploit the particularly strong capillary forces of metallic melts for the manufacture of strands of smaller diameter. One does not use a smooth spinning wheel but rather a melt spinning wheel, which is structured with elongate circumferentially extending grooves (recesses). If now the quantity of metallic melt incident on the rotating wheel is reduced to the extent that only one recess or a few recesses, and/or the land or lands between adjacent recesses are wetted then one obtains a lateral braking up of the planar metallic (liquid) film as a result of the recesses formed in the wheel and the capillary forces that are acting. To a first approximation the lateral dimension of the resulting strand reflects the lateral dimension of the structuring of the wheel. However, a further reduction of the quantity of melt which strikes the wheel per unit of time results in the amalgamation or collection of the quantity of metallic melt at a corner or an edge of the structure on the wheel as a result of the capillary forces that are acting. Thus the melt deposits along a corner such as an edge of a recess of the wheel or along the base of a recess in the wheel. This makes it possible to obtain very much smaller geometries of the strands than might be expected from the dimensions of the actual structuring of the wheel. Thus, with a lateral structure size of 1 mm it is possible to obtain a ribbon of 0.4 mm width. The deposition rate of the metallic melt on the copper wheel and the structuring of the wheel are thus of decisive importance for the invention. The deposition rate of the metallic melt can be controlled by the speed of rotation of the wheel, by the size of the opening of the crucible and by the pressure with which the melt is pressed through the opening of the crucible. As the length of the nozzle opening transverse to the structured circumferential surface of the wheel extends typically over a plurality of grooves and or lands plural stands can be formed at any one time due to the lateral breaking up of the molten metal on the circumferentially structured surface of the wheel. Reducing the width of the nozzle in the circumferential direction of the wheel reduces the amount of metal forming each strand per unit of time and thus results in the strands becoming finer, i.e. having a reduced transverse dimension or dimensions.

The structure on the wheel can generally be produced by a technical turning operation such as on a lathe, by milling or by laser ablation. The abrupt solidification of the metallic melt and the high centrifugal forces resulting from the rotation of the wheel lead to the capillary forces becoming unimportant and thus to the wire that is forming being flung away from the wheel, so that it can then be collected in a known collection device. After the solidification of the melt the metal normally forms no droplets and the wire can now be further processed, e.g. worked into a textile fleece or felt. Thus the melt spinning method can be combined with a method of manufacturing textiles.

Preferred embodiments of the invention are set forth in the subordinate claims.

Figure 4:
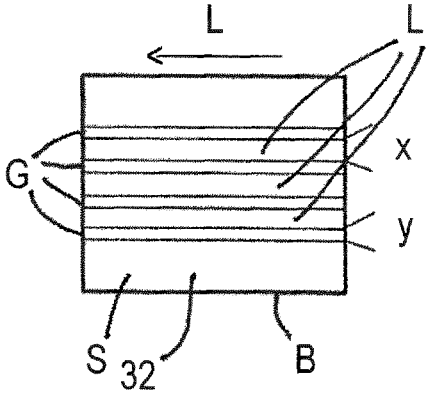
Figure 6:
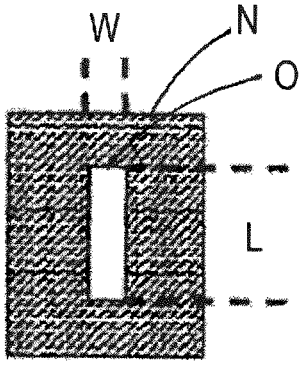
Figure 5:
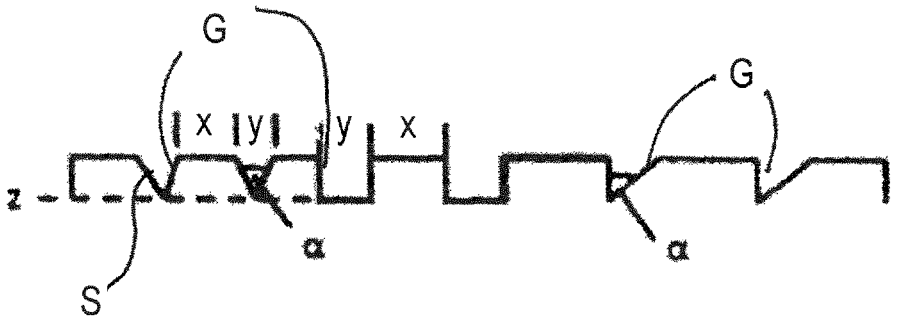
Figure 2:
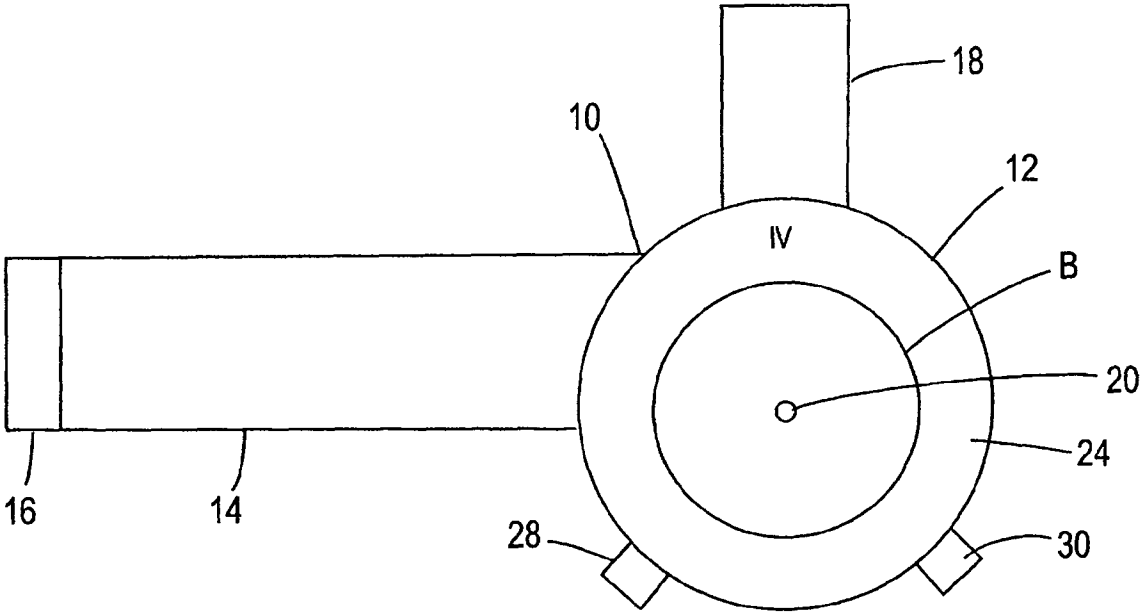
Figure 3:
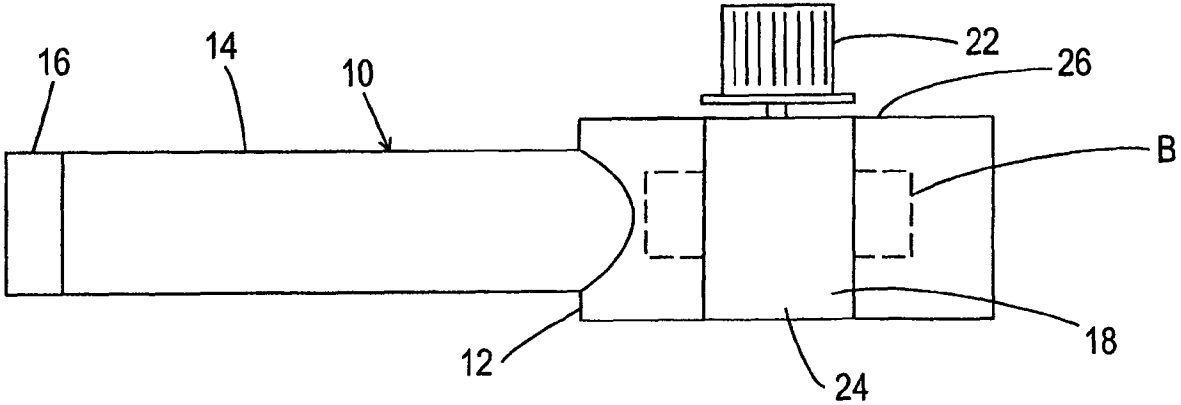
Figure 7:
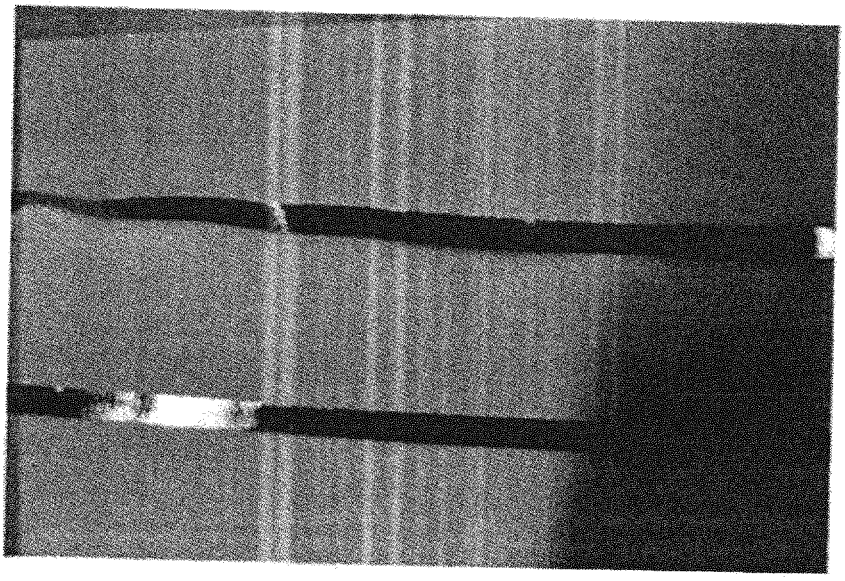
Figure 8:
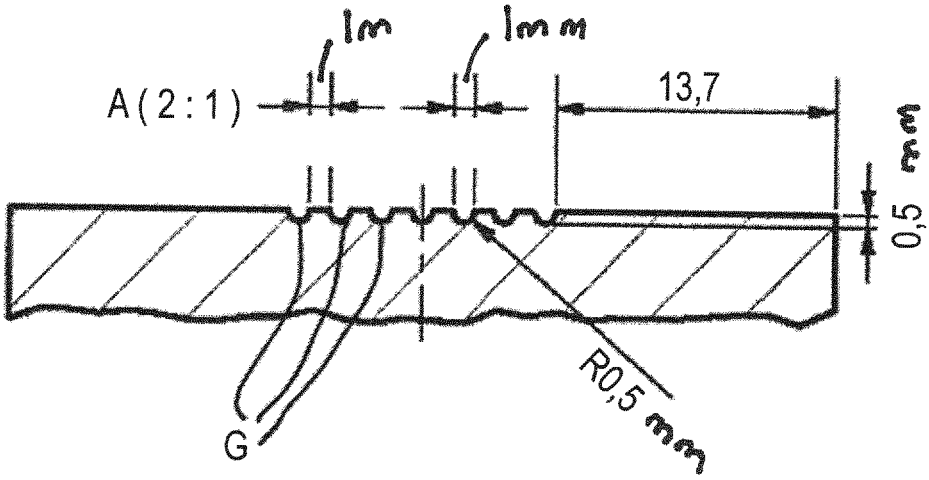
Figure 9:
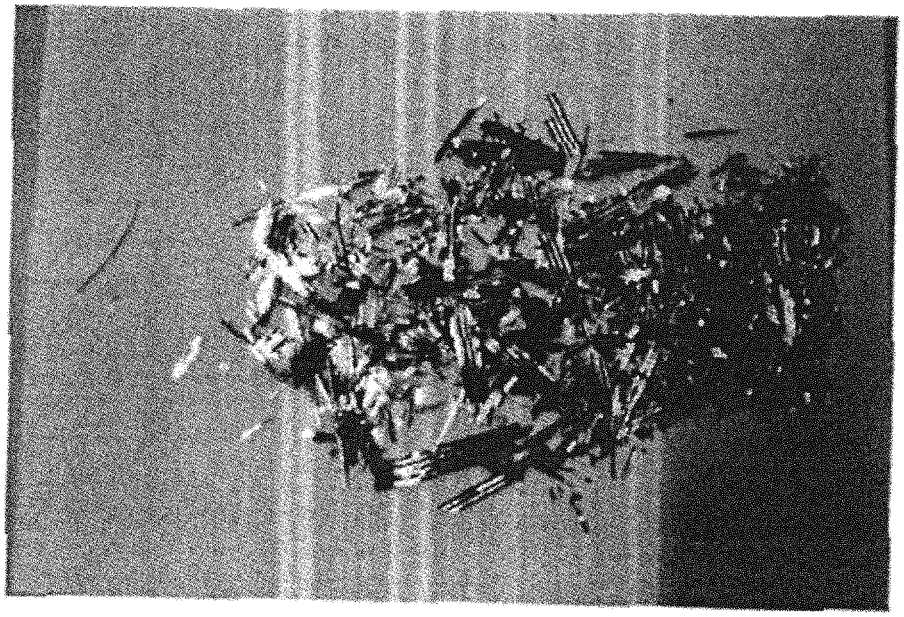
Figure 10:
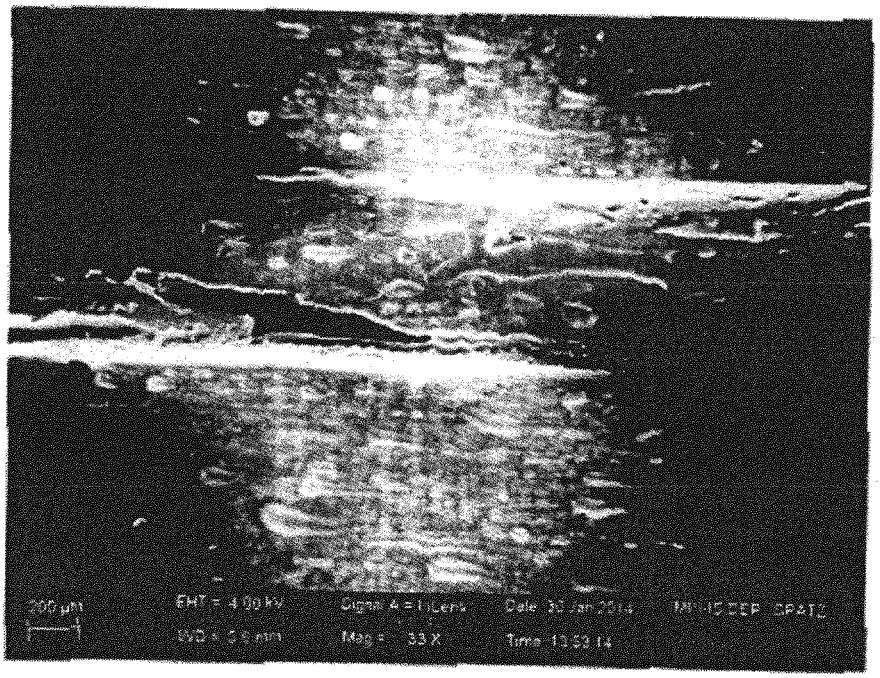
Figure 11:
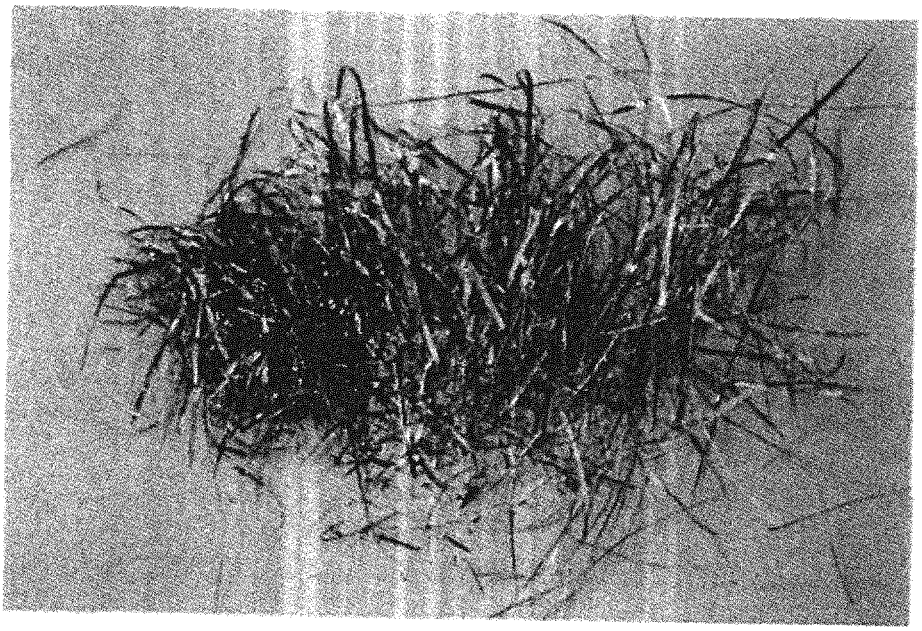
Figure 13:
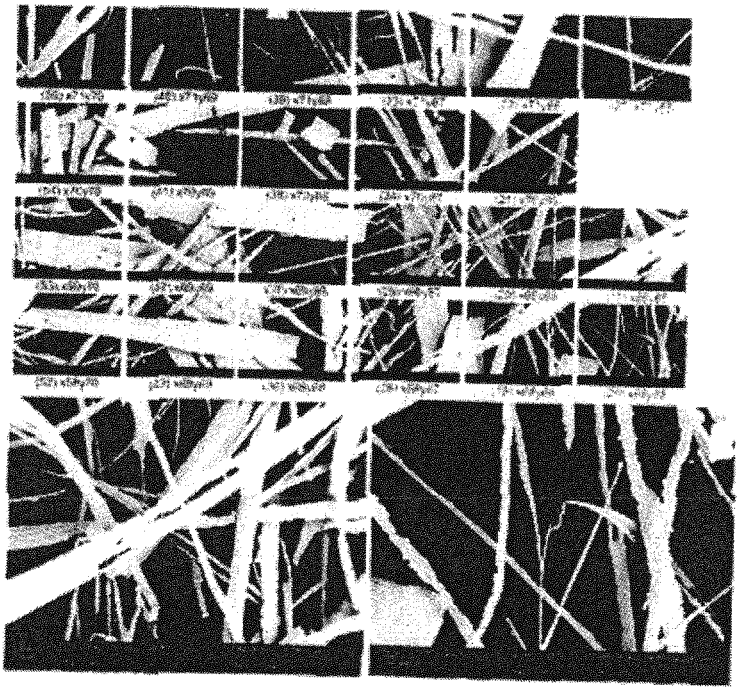
Figure 12:
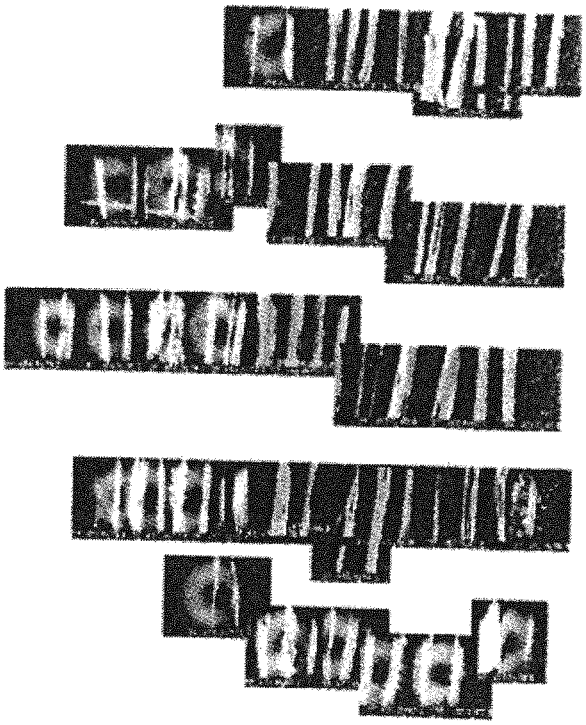
Figure 12:
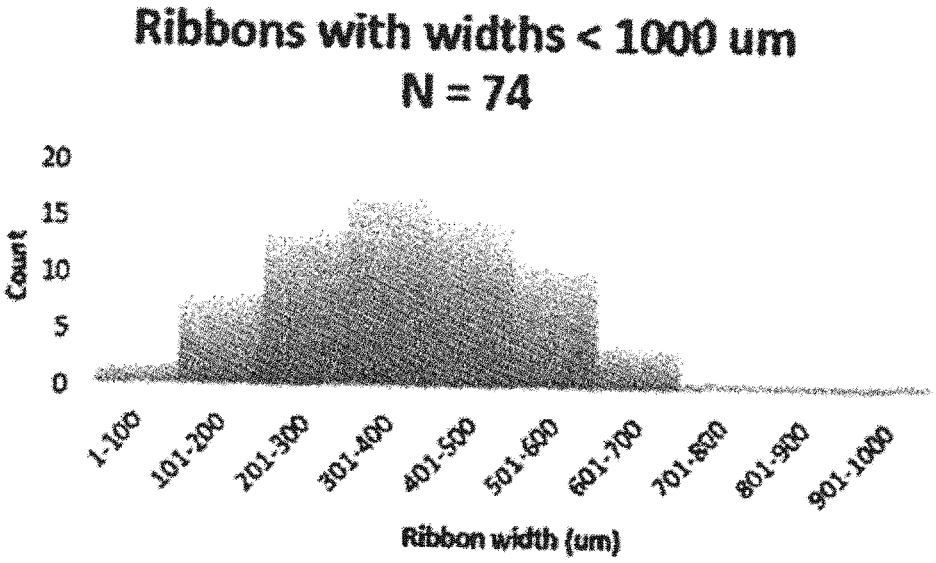
Figure 14:
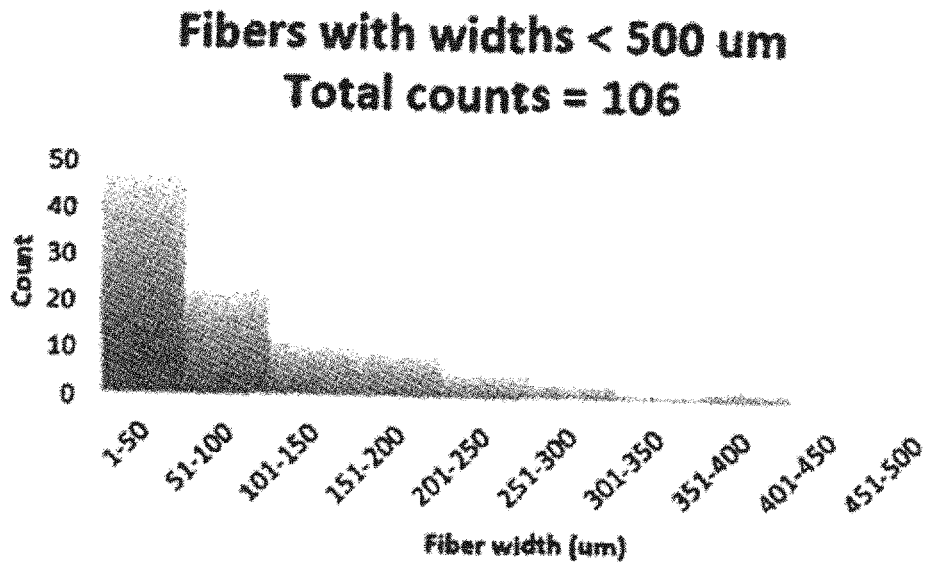
Figure 14:
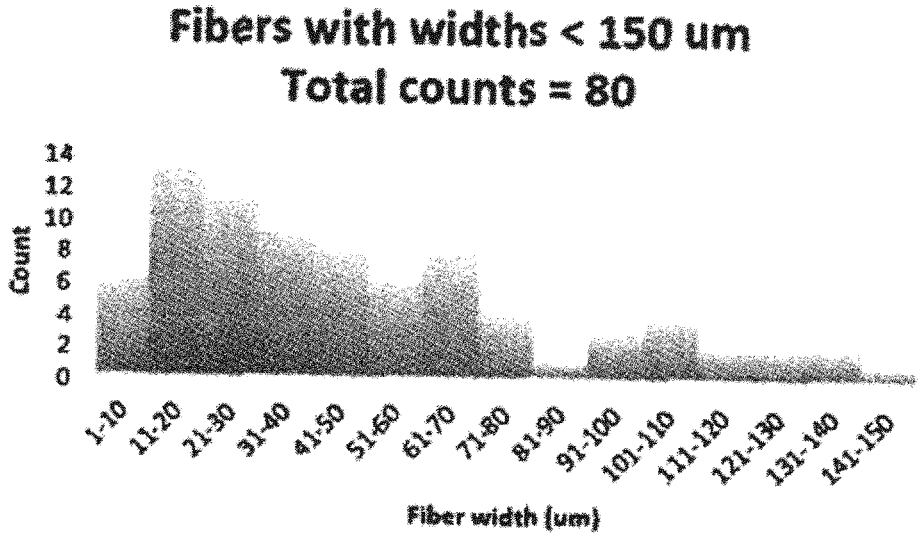
Figure 15A:
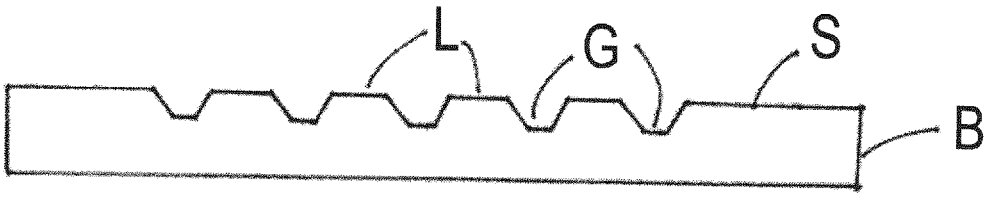
Figure 15B:
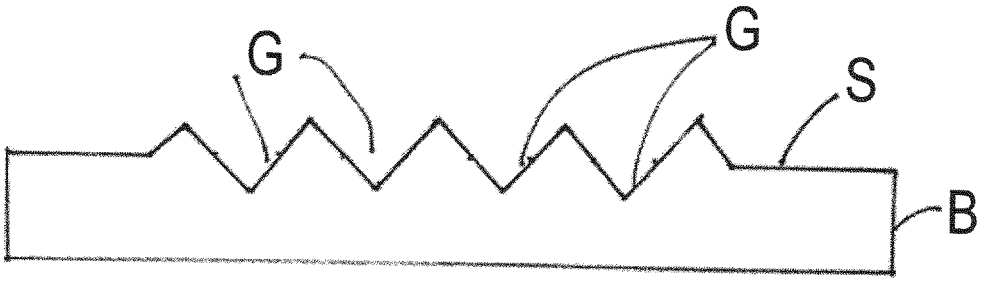
Figure 15C:
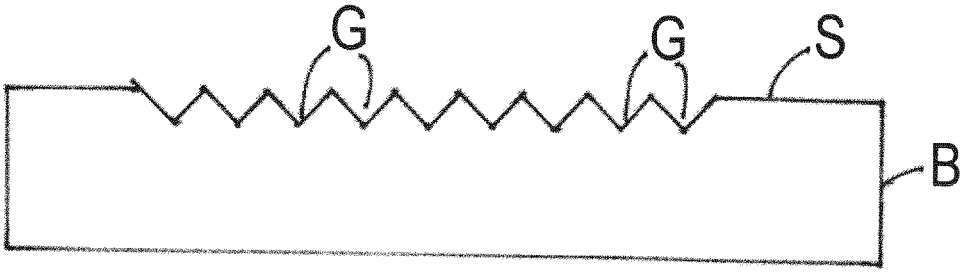
Figure 16A:
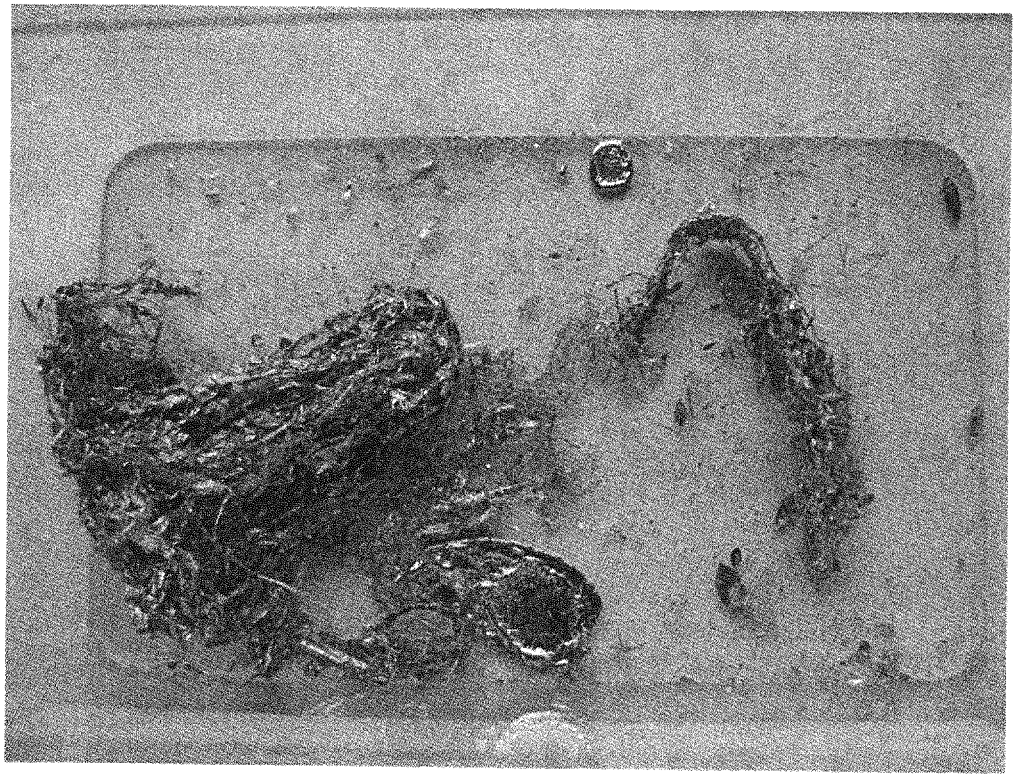
Figure 16B:
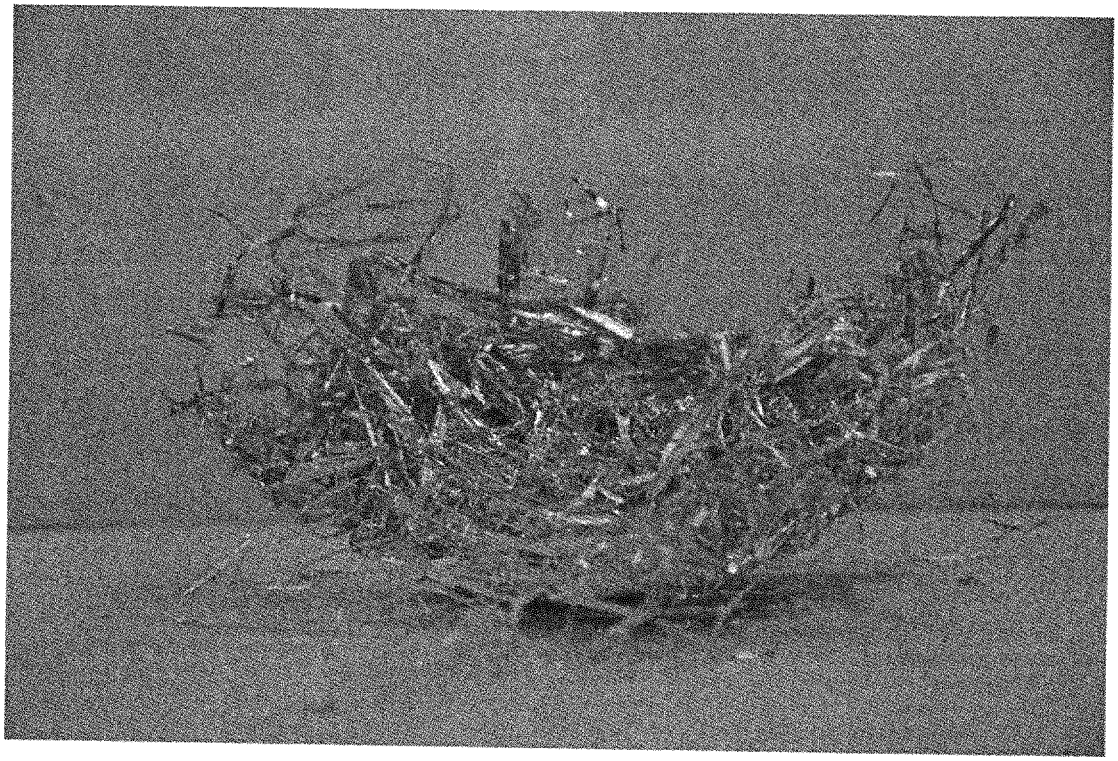
Figure 16C:
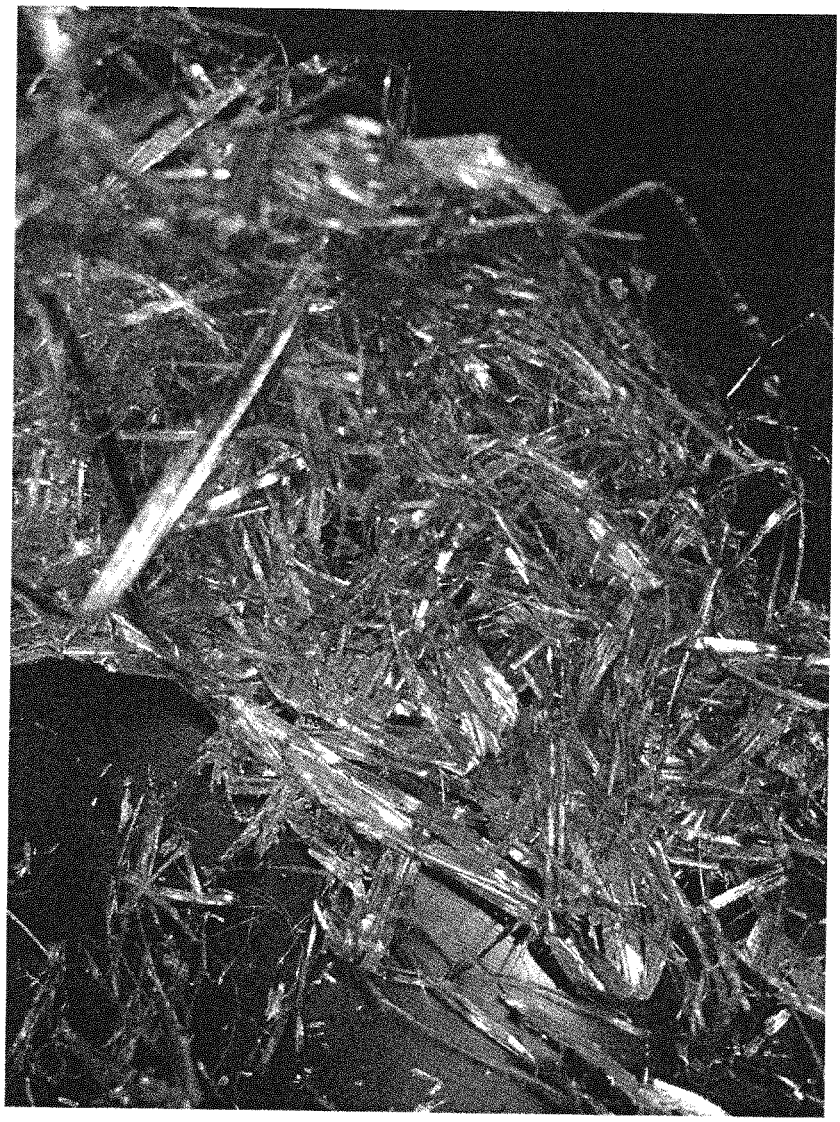
Figure 17:
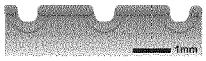
Figure 17:
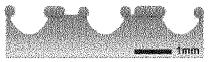
Figure 17:
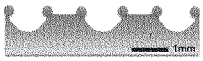
Figure 17:
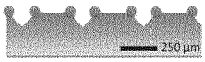
Figure 17:
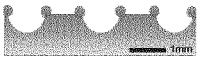
Figure 17:
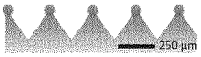
Figure 17:
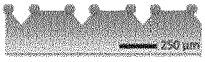
Figure 18:
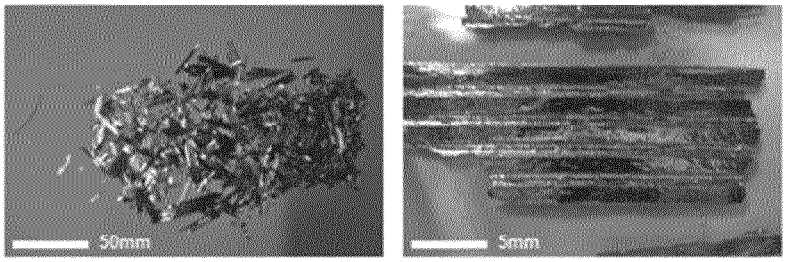
Figure 18:
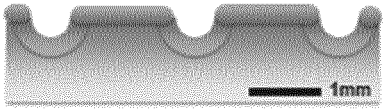
Figure 19:
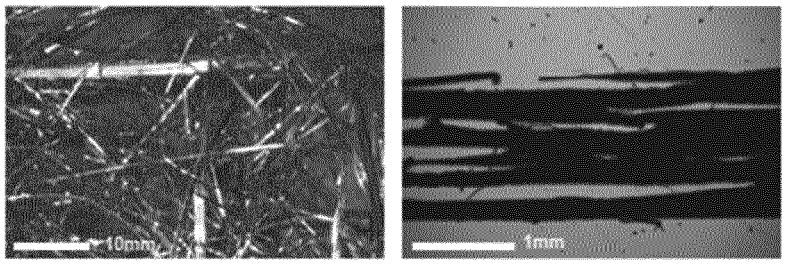
Figure 19:
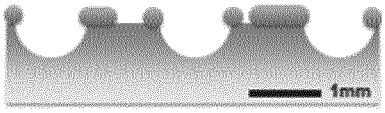
Figure 22:
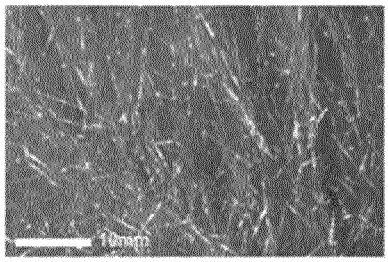
Figure 23:
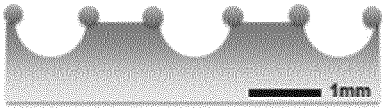
Figure 23:
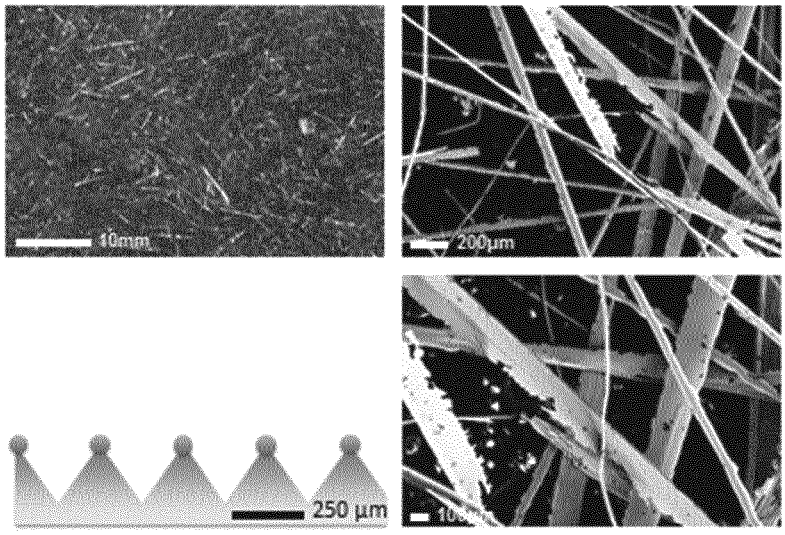

The invention will now be described in further detail and by way of example only with reference to the accompanying drawings and various examples of the method of the invention. In the drawings there are shown:

FIG. 1 a schematic illustration of the basic melt spinning process,

FIG. 2 a front view of the apparatus used for melt spinning equipped with the rotatable wheel of the present invention, FIG. 3 a detail view of the apparatus of FIG. 2 as seen in a front view with the housing removed, FIG. 4 a top view of part of the circumferential surface of the spinning wheel of FIGS. 2 and 3 showing a structure applied to the circumferential surface, FIG. 5 a cross-section through possible structures for the circumferential surface of the wheel of FIGS. 2 and 3, FIG. 6 a top view of the discharge orifice of the crucible with an explanatory sketch, FIG. 7 a photograph of a melt spun ribbon of an Fe40Ni40B20 alloy spun on a copper wheel of 200 mm diameter rotating at 30 Hz, FIG. 8 a view similar to FIG. 5 but with a different structure and quoting dimensions to support the test of Example 1, FIG. 9 a photograph of the Fe40Ni40B20 ribbon of FIG. 7 as produced in bulk by melt spinning, FIG. 10 an SEM image showing the partial break-up of the ribbon material in the round groove of FIG. 8, FIG. 11 a photograph similar to FIG. 9 but showing the Fe40Ni40B20 ribbon formed with the same copper wheel but now rotating at 60 Hz, FIG. 12 a diagram showing the statistical size distribution of ribbon widths less than 100 μm for a sample of 74 ribbons, FIG. 13 a diagram illustrating the statistical size variation in width of ribbons produced by means of the invention, FIG. 14 two diagrams showing the statistical size distribution of ribbons from the sample of FIG. 9 for ribbons less than 500 μm (106 sample ribbons) and less than 150 μm (80 sample ribbons), FIGS. 15A to 15C examples of alternative surface structures possible for the wheel of FIGS. 2 and 3, FIGS. 16A to 16C examples of further melt spun ribbons, FIG. 17 a table summarizing the results of Examples 5 to 10, FIG. 18 a series of photographs of the product of Example 5 together with a scale drawing of the cross section of groove profile that is used at the surface of the wheel, FIG. 19 a series of photographs of the product of Example 6 together with a scale drawing of the cross section of groove profile that is used at the surface of the wheel, FIG. 20 a series of photographs of the product of Example 7 together with a scale drawing of the cross section of groove profile that is used at the surface of the wheel, FIG. 21 a series of photographs of the product of Example 8 together with a scale drawing of the cross section of groove profile that is used at the surface of the wheel, FIG. 22 a series of photographs of the product of Example 9 together with a scale drawing of the cross section of groove profile that is used at the surface of the wheel, FIG. 23 a series of photographs of the product of Example 10 together with a scale drawing of the cross section of groove profile that is used at the surface of the wheel, Turning now to the schematic drawing of the melt spinning process shown in FIG. 1 it can be seen that the metal A to be spun is heated in a crucible K by an electrical heating device I. A gas pressure P presses the molten metal through the nozzle N of the crucible K onto the rotating wheel B. The wheel B has a surface structure S (schematically illustrated in FIGS. 4 and 5) which laterally restricts the molten metal incident on the circumferential surface of the wheel before it solidifies and is thrown off by centrifugal force. The nozzle N of the crucible K is likewise structured and can, for example, have a nozzle opening O of rectangular shape as shown in FIG. 6. From FIG. 6 and the schematic diagram of FIG. 4 it can be seen that the length direction L of the nozzle opening is oriented transversely to the circumferential direction C of the groves G in the circumferential surface S of the wheel B and extends over several of these grooves and in a practical example over at least most of the grooves so that the nozzle opening distributes molten metal across the width of the surface structure on the wheel B. The width W of the slot can be chosen within relatively wide limits, e.g. between 1 mm and 10 μm to control the rate of flow of the molten metal from the nozzle N onto the structured surface S of the wheel B. When the width W is relatively large a relatively high flow rate for the molten metal onto the structured surface of the wheel B is obtained and, for a given speed of the wheel, the strands produced are of relatively large cross-section. As the width W is reduced, which is achieved by substituting one crucible K for another one with the desired nozzle width W, the flow rate of the molten metal onto the structured circumferential surface S of the wheel B is reduced and, for the same speed of rotation of the wheel, the strands produced are relatively smaller in cross-section.

The pressure P applied to the molten metal can also be used to change the flow rate. Clearly a relatively large pressure leads to a higher flow rate than a relatively lower pressure. A minimum pressure P is always required in order to force the molten metal through the nozzle N, as gravity alone is not normally sufficient to ensure adequate flow, particularly with a relatively small width W of the nozzle opening. In fact this is advantageous because otherwise some form of valve would be necessary and a valve for regulating the flow of molten metal is technically challenging. It should be noted that the pressure difference ΔP is dependent on the metal used and on the width of the nozzle opening in the circumferential direction. It is also dependent on the length of the nozzle opening in a direction parallel to the axis of rotation of the wheel. The length of the nozzle opening can be varied within wide limits. For laboratory experiments values of 10 to 12 mm have been found useful. In production much greater lengths could be selected in dependence on the axial width of the circumferential surface of the wheel.

FIG. 4 schematically shows a structured peripheral surface S of a wheel B having four grooves or recesses G and a lands L between them. Generally there will be many more circumferentially extending grooves G with circumferentially extending lands L between them, each land L being disposed between two circumferentially extending recesses G. The boundary between each groove G and an adjacent land L defines a circumferentially extending edge or corner.

The grooves or recesses G can have a cross-sectional shape selected from the group comprising semi-circular, symmetrically v-shaped, asymmetrically v-shaped, rectangular and trapezoidal and grooves G of this kind are shown in FIGS. 5, 8 and 15A to 15C as well as in FIGS. 17 to 23. It will be appreciated that further circumferentially extending edges or corners are formed at the base of the grooves G and can also form positions at which molten metal preferentially collects. Strictly speaking it is not necessary for lands to be present at all, the grooves or recesses G could have a cross-sectional shape corresponding to a v-shaped machine thread (as shown in FIGS. 15B and 15C and indeed such grooves G could either extend strictly circumferentially around the circumferential surface of the wheel B or could take the form of a screw thread having a pitch, For a relatively fine thread a correspondingly small pitch is appropriate.

When lands are provided they generally have widths of 1 mm or less.

As can be seen from FIG. 4 the grooves G can have a width x and the lands L a width y. These dimensions provide flexibility in tailoring the process to produce relatively uniform strands of selected dimensions. As the nozzle opening O extends over a plurality of grooves G the volume of the grooves, which is related to their width x acts to collect molten metal and has an influence on the size of the strands. Generally speaking the narrower x is the smaller is the volume of the groove G and the smaller is the cross section of the strands that are produced. The width y of the lands L affects the heat removal from the molten metal and also has an influence on the cross-sectional shape of the strands and the length thereof.

The overall aim of the tests carried out to date is to investigate whether the melt spinning process can produce thin fibers with diameters in the micron range, for industrial applications such as light weight, mechanically strengthened textiles (textiles reinforced by the metal strands), filters and catalytically active materials. The actual apparatus used is shown in FIGS. 2 and 3. Apart from the design of the wheel B the apparatus shown in FIGS. 2 and 3 is a commercially available melt spinner obtainable from the company Edmund Buehler GmbH, Hechingen, Germany. It consists of a metallic chamber 10 having a cylindrical portion 12 and a tangentially extending collection tube 14 with a closable port 16 at the end remote from the cylindrical portion 12. Above the cylindrical portion 12 the crucible K with the electrical heating system I and the gas pressure supply P are mounted within a short cylindrical extension 18 of the chamber 10 and provided with the necessary supply lines for a pressurized gas such as argon, for electrical power and control of the gas flow valve determining the pressure P, for the power of the heating system I and for the monitoring of parameters such as gas pressure and temperature of the melt. The wheel B is mounted on the inside of and concentric to the cylindrical portion 12 and is supported by bearings (not shown) on an axle 20 driven by an electric motor 22 flanged to the rear of the cylindrical portion 12 (see FIG. 3). The front side 24 of the cylindrical portion, i.e. the side 26 opposite the drive motor 22 is made of glass so that the spinning process can be observed and filmed by a high speed camera. The chamber 10 can be evacuated by a vacuum pump via an evacuation stub 28 and can be supplied with a flow of an inert or reactive gas via a further feed stub 30. Thus a desired atmosphere at a desired temperature and pressure can be provided within the chamber 10.

The cover for closing the port 16 can be a hinged or removable glass cover permitting the material collected in the cylindrical extension 18 to be observed, removed and filmed as required.

The following experiments were conducted:

COMPARATIVE EXAMPLE 1

In the first experiment melt spun ribbons were generated on a standard copper wheel B with a diameter of 200 mm and a smooth circumferential surface 32 (indicated in FIG. 4) having the shape of a right cylinder. A melt of Fe 40Ni40B20 is formed by the heating system I within the boron nitride crucible K. The crucible K has a slit orifice with nominal dimensions, length L=10 mm and width W=0.4 mm. Once the metal has melted gas pressure is applied to the molten gas by the pressure source P to expel the molten metal through the orifice and onto the copper wheel B. The copper wheel B was rotated by the drive motor at a wheel drive frequency of 30 Hz. The mass of the metal sample was ca. 10 g. As shown in FIG. 7, a single continuous ribbon was generated, which had a length of >1 m, a typical width of 9.3+1−0.1 mm, and a typical thickness of 42+1−2 microns. FIG. 7 shows that the ribbons manufactured in this way are of good quality.

The specific parameters used were as follows:

| | |
|---|---|
| Weight of metal sample | 10 g |
| Length L of nozzle opening | 10 mm |
| Width W of nozzle opening | 0.4 mm |
| Temp. of wheel | RT |
| Gas in chamber | Argon |
| Pressure in chamber 12 | 400 mbar |
| Temp. of gas in chamber 12. | RT |
| Temperature of molten metal | 1350° C. |
| Pressure applied to molten metal | 200 mbar (overpressure) |
| Speed of wheel | 30 Hz |
| Diameter of wheel | 200 mm |
| Distance between wheel and orifice | 0.2 mm |

ILLUSTRATIVE EXAMPLE 1

Using the same apparatus as in FIGS. 2 and 3 the smooth copper wheel was then replaced by a copper wheel of the same size, but having the structure shown in FIG. 8 at its right cylindrical surface. The melt spinning process was then repeated using the same parameters as in comparative example 1. The drawing of the wheel structure shown in FIG. 8 comprises 7 grooves of semicircular cross-section with a diameter of 1 mm, with a 1 mm spacing or land between adjacent pairs of grooves. As can be seen in FIG. 9, the resultant strands took the form of ribbons molded according to the surface structure of the wheel. They had a typical length of only a few cm, and widths varying from ~2 to ~9 mm. Thicknesses of around 200 micron were measured using a thickness gauge, however an accurate measurement was hindered by the curvature of the ribbons and their brittleness. The brittleness of the ribbons is thought to be caused by their crystalline structures, which may be in turn effected by the insufficient thermal coupling between the wheel and the ribbons. The ribbons produced by the use of the structured wheel of FIG. 8 are shown in the photograph of FIG. 9.

To investigate the microstructure of the melt-spun ribbons shown in FIG. 9 SEM images were acquired at a low magnification. A typical example is shown in FIG. 10 which revealed the partial break-up of the ribbon in the groove (and not in the material in the webs between the grooves). The ribbons resulting from the inventive example 1 have significant uniformity, meaning that the collection of strands has a preferred orientation in which the lengths of the individual strands are substantially in parallel to one another and have a substantially similar length.

INVENTIVE EXAMPLE 1

For this example the aim was to make the single ribbons finer by promoting the break-up of the liquid melt on the copper wheel by reducing the volume of the liquid pool forming on the wheel between the wheel surface and the orifice of the crucible K. This concept was based on the recognition that single ribbons with 1 mm widths would have been generated on the flat surfaces in between the semicircular grooves, if the breakup of the ribbon material could be promoted to reach completion. In this example, this was achieved using the same structured surface as in Illustrative Example 1, and the same set of parameters as in Comparative Example 1 but by increasing the speed of rotation of the wheel B to 60 Hz corresponding to a surface speed of the wheel of 37.5 m/s. The resultant ribbons are shown in FIG. 11. As can be seen in this figure, narrow ribbons were obtained from this experiment. They had lengths of around 10 cm, a typical width of 1.3+/−0.5 mm, and a typical thickness of 31+/−8 microns. About 30% of the initial mass was found to be transformed into the ~1 mm wide ribbons. The remaining product comprised flakes of the material (Fe40Ni40B20) and crumbling ribbon material with a typical length of about 1 cm, not shown in FIG. 11.

The mass and size distribution of the strands shown in the photograph of FIG. 11 resulted in the following result illustrated in FIG. 12:

Total mass=9.70 g (100%)

Mass of agglomerated strands=2.83 g (29%);

Length of the strands: plural centimetres (10 cm);

Typical width: ca. 1.3 mm

Mass of remaining material: 6.73 g (69%) Mass of material lost; =0.14 g (1%).

The diagrams of FIG. 12 show that the useful strands of material had a size distribution with the majority of strands having widths in the range from 200 μm to 500 μm.

INVENTIVE EXAMPLE 2

In this example the same basic set-up was retained as for Inventive Example 1 but the pressure on the melt was reduced to 100 mbar in order to reduce the deposition rate of the melt onto the spinning wheel. This resulted in two types of metal strands:

Metallic strands in the form of agglomerations of similar strands with homogenous diameters and of several cm's length and strands in the form of a fiber mix including all the remaining fiber products.

The following results were obtained:

Total mass 6.06 g (100%),

Mass of agglomerated strands 4.18 g (69%)

Average width 389 μm+/−167 μm

Average thickness 28 μm+/−7 μm

Length of strands ca 10 cm

Residual mix 1.66 g (27%)

Length several mm's,

Average width of ca. 20 μm

Material loss 0.22 g (4%)

FIG. 11 shows the Fe4ONi4OB2O ribbons generated using the structured wheel and slit orifice of Inventive example 2 and FIG. 12 shows the narrow distribution of sizes of the useful metal strands forming 60% of the resulting material.

FIG. 13 shows another characterization of the metal mix, i.e. the useful strands of Inventive Example 3. FIG. 14 shows the distribution of strands having widths less than 500 μm. As can be seen a large proportion of the strands has a width in the range of 1 to 50 μm. The second diagram of FIG. 14 shows the distribution of strands for widths in the range of 1 to 150 μm, it can be seen that a large proportion of strands have widths in the range from 4 to 40 μm.

INVENTIVE EXAMPLE 3

In this case the parameters used were as follows:

Material lead (Pb)

Surface structure, size and speed of rotation of copper wheel as in inventive example 1

| | |
|---|---|
| Weight of metal sample | 9.04 g |
| Nominal length of nozzle opening | 10 mm |
| Nominal width of nozzle opening | 0.4 mm |
| Temp of wheel | RT (~23° C.) |
| Gas in chamber | Argon |
| Pressure in chamber 12 | 400 mbar |
| Temp. of gas in chamber 12 | RT |
| Ejection temperature | 400° C. < $T_{ejection}$ < 700° C. |
| Ejection pressure | 100 mbar |
| Speed of wheel | 60 Hz |
| Diameter of wheel | 200 mm |
| Distance between nozzle and wheel | 0.3 mm |
| Average width of the resultant ribbon | 0.7 +/− 0.05 mm |
| Average thickness of the resultant ribbon | 59 μm +/− 23 μm |

The ribbons produced in this way are shown in FIG. 16A.

INVENTIVE EXAMPLE 4

In this case the parameters used were as follows:

Material Aluminium (Al)

| | |
|---|---|
| Weight of metal sample | 4.85 g |
| Nominal length of nozzle opening | 10 mm |
| Nominal width of nozzle opening | 0.4 mm |
| Temp of wheel | RT (~25° C.) |
| Gas in chamber | Argon |
| Pressure in chamber 12 | 400 mbar |
| Temp. of gas in chamber 12 | RT |
| Ejection temperature | 900° C. |
| Ejection pressure | 200 mbar |
| Speed of wheel | 60 Hz |
| Diameter of wheel | 200 mm |
| Distance between nozzle and wheel | 0.3 mm |
| Average width of the resultant ribbon | 2.0 +/− 0.3 mm |
| Average thickness of the resultant ribbon | 46 μm +/− 10 μm |

In the following further examples will be given of fibres produced using different parameters of the melt spinning process using a structured wheel. In all the following examples the wheel is a copper wheel having various groove configurations which are illustrated in the summary of FIG. 17 together with an indication of how the topography of the grooves is wetted by the melt;

EXAMPLE 5

| | |
|---|---|
| Material: Fe40Ni40B20 | Experiment MS03 |
| Nominal length of nozzle opening | 10 mm |
| Nominal width of nozzle opening | 400 μm |
| Temp of wheel | RT (~23° C.) |
| Gas in chamber | Argon |

-continued

| | |
|---|---|
| Pressure in chamber 12 | 400 mbar |
| Temp. of gas in chamber 12 | RT |
| Ejection temperature | 1350° C. |
| Ejection pressure | 200 mbar |
| Speed of wheel | 30 Hz |
| Diameter of wheel | 200 mm |
| Distance between nozzle and wheel | 0.3 mm |
| Average width of the resultant ribbon | Textured ribbon, lamella with the profile of the grooved structure, see FIG. 17 |
| Average thickness of the resultant ribbon | Experiment failed |

The textured ribbon produced in this experiment is shown in photographs with different magnifications in FIG. 18 together with an enlarged cross sectional profile of the grooves used for this Example 5 and showing the groove width. The profile of the grooves is shown to scale. In the photograph at the top left the scale bar is 50 mm and in the photograph at the top right 5 mm. The scale bar in the profile diagram indicates 1 mm in length. In the profile diagram for the wheel, which is the same as the corresponding profile diagram in FIG. 17 for the Experiment MS03, it can be seen that the metal film forms a layer over the whole profiled surface of the roll.

EXAMPLE 6

| | |
|---|---|
| Material: Fe40Ni40B20 | Experiment MS23 |
| Nominal length of nozzle opening | 10 mm |
| Nominal width of nozzle opening | 400 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1350° C. |
| Ejection pressure | 200 mbar |
| Speed of wheel | 85 Hz |
| Diameter of wheel | 200 mm |
| Distance between nozzle and wheel | 0.3 mm |
| Average width of the resultant ribbon | Textured ribbon, the lamella breaks up and no longer follows the shape of the groove |
| Average thickness of the resultant ribbon | Experiment failed |

The textured ribbon produced in this experiment is shown in photographs with different magnifications in FIG. 19 together with an enlarged cross sectional profile of the grooves used for this Example 6 and showing the groove width. The profile of the grooves is shown to scale. In the photograph at the top left the scale bar indicates 10 mm and in the photograph at the top right 1 mm. The scale bar in the profile diagram indicates 1 mm in length. In the profile diagram for the wheel, which is the same as the corresponding profile diagram in FIG. 17 for the Experiment MS23, it can be seen that the metal film forms layers of irregular width over parts of profiled surface of the roll.

EXAMPLE 7

| | |
|---|---|
| Material: Fe40Ni40B20 | Experiment MS34 |
| Nominal length of nozzle opening | 10 mm |
| Nominal width of nozzle opening | 100 μm |
| Temp of wheel | RT (~23° C.) |
| Gas in chamber | Argon |
| Pressure in chamber 12 | 400 mbar |

-continued

| | |
|---|---|
| Temp. of gas in chamber 12 | RT |
| Ejection temperature | 1350° C. |
| Ejection pressure | 400 mbar |
| Speed of wheel | 85 Hz |
| Diameter of wheel | 200 mm |
| Distance between nozzle and wheel | 0.3 mm |
| Width of the resultant ribbons | Max 171.4 μm, min 10.4 μm |
| Thickness of the resultant ribbon | <5 μm |

The fibres produced in this experiment are shown in photographs with different magnifications in FIG. 20 together with an enlarged cross sectional profile of the grooves used for this Example 7 and showing the groove width. The profile of the grooves is shown to scale. In the photograph at the top the scale bar indicates 10 mm. The scale bar in the profile diagram indicates 1 mm in length. In the profile diagram for the wheel, which is the same as the corresponding profile diagram in FIG. 17 for the Experiment MS34, it can be seen that the metal film has been split up and is concentrated at the edges of the recesses or grooves adjacent the lands.

EXAMPLE 8

| | |
|---|---|
| Material: Fe40Ni40B20 | Experiment MS031 |
| Nominal length of nozzle opening | 10 mm |
| Nominal width of nozzle opening | 100 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1350° C. |
| Ejection pressure | 400 mbar |
| Speed of wheel | 85 Hz |
| Diameter of wheel | 200 mm |
| Distance between nozzle and wheel | 0.3 mm |
| Average width of the resultant ribbons | Max 146.2 μm, min8.4 μm |
| Thickness of the resultant ribbons | <5 μm |

The fibres produced in this experiment are shown in photographs with different magnifications in FIG. 21 together with an enlarged cross sectional profile of the grooves used for this Example 8 and showing the groove width. The profile of the grooves is shown to scale The scale bar in the drawing of the profile indicates 250 μm. In the photograph at the top the scale bar indicates 10 mm. In the profile diagram for the wheel, which is the same as the corresponding profile diagram in FIG. 17 for the Experiment MS31, it can be seen that the metal film has been split up and is concentrated at the edges of the recesses or grooves adjacent the lands.

EXAMPLE 9

| | |
|---|---|
| Matterial: Fe40Ni40B20 | Experiment MS37 |
| Nominal length of nozzle opening | 10 mm |
| Nominal width of nozzle opening | 50 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1350° C. |
| Ejection pressure | 1000 mbar |
| Speed of wheel | 85 Hz |
| Diameter of wheel | 200 mm |
| Distance between nozzle and wheel | 0.3 mm |
| Width of the resultant ribbons | Max 48.4 μm, min 9.3 μm |
| Thickness of the resultant ribbon | <5 μm |

The fibres produced in this experiment are shown in photographs with different magnifications in FIG. 22 together with an enlarged cross sectional profile of the grooves used for this Example 9 and showing the groove width. The profile of the grooves is shown to scale. In the photograph at the top the scale bar indicates 10 mm. The scale bar in the profile diagram indicates 1 mm in length. In the profile diagram for the wheel, which is the same as the corresponding profile diagram in FIG. 17 for the Experiment MS37, it can be seen that the metal film has been split up and is concentrated at the edges of the recesses or grooves adjacent the lands.

EXAMPLE 10

| | |
|---|---|
| Material: Fe40Ni40B20 | Experiment MS33 |
| Nominal length of nozzle opening | 10 mm |
| Nominal width of nozzle opening | 100 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1350° C. |
| Ejection pressure | 400 mbar |
| Speed of wheel | 60 Hz |
| Diameter of wheel | 200 mm |
| Distance between nozzle and wheel | 0.3 mm |
| Width of the resultant fobres | Max 75.1 μm, min 2.8 μm |
| Thickness of the resultant fibres | <5 μm |

The fibres produced in this experiment are shown in photographs with different magnifications in FIG. 23 together with an enlarged cross sectional profile of the grooves used for this Example 10 and showing the groove width. The profile of the grooves is shown to scale. In the photograph at the top left the scale bar indicates 10 mm, in the photograph at the top right the scale bar indicates 200 μm and in the photograph art the bottom left the scale bar indicates 1000 μm. The scale bar in the profile diagram indicates 250 μm in length. In the profile diagram for the wheel, which is the same as the corresponding profile diagram in FIG. 17 for the Experiment MS33, it can be seen that the metal film has been split up and is concentrated at the apices, i.e. at the edges of the recesses or grooves.

EXAMPLE 11

| | |
|---|---|
| Material: Stainless steel V2A | Experiment MS058 |
| Nominal length of nozzle opening | 10 mm |
| Nominal width of nozzle opening | 75 μm |
| Temp of wheel | RT (~23° C.) |
| Gas in chamber | Argon |
| Pressure in chamber 12 | 400 mbar |
| Temp. of gas in chamber 12 | RT |
| Ejection temperature | 1550° C. |
| Ejection pressure | 800 mbar |
| Speed of wheel | 95 Hz |
| Diameter of wheel | 200 mm |
| Distance between nozzle and wheel | 0.3 mm |
| Width of the resultant fibres | Max 144 μm, min 2.3 μm |
| Thickness of the resultant fibres | <5 μm |

The values of all the examples 5 to 11 are summarized—together with other relevant values—in the Table of FIG. 17 classified by the experiment number and FIG. 17 includes sketches illustrating the profile of the grooved surface of the wheel used for each experiment.

The invention claimed is:

1. An apparatus for producing elongate strands of metal, the apparatus comprising a rotatable wheel having a circumferential surface, the circumferential surface having circumferentially extending edges and recesses formed between or bounded by the edges, each recess of the recesses defining a depth and a width with the depth being greater than 100 μm and the width being greater than 100 μm, a nozzle defining a nozzle opening having a width of between 10 μm to 100 μm for directing a molten metal onto the circumferential surface and to form solidified strands of metal on the circumferential surface from the molten metal, wherein the nozzle has a rectangular cross-section having a width of the nozzle opening in the circumferential direction of rotation of the wheel and a length transverse to the circumferential surface of the wheel which is greater than the width W, and wherein an apparatus is provided for controlling a gas pressure applied to the liquid metal which moves the liquid metal through the nozzle opening and delivers it to the circumferential surface of the rotatable wheel, wherein said wheel is mounted and configured to rotate within a chamber having an atmosphere at a higher pressure than ambient pressure.

2. The apparatus in accordance with claim 1, wherein the circumferential recesses defining the edges have a radial depth greater than 50 μm; and/or wherein the recesses have a cross-sectional shape selected from the group of members consisting of semi-circular, symmetrically v-shaped, asymmetrically v-shaped, rectangular and trapezoidal.

3. The apparatus in accordance with claim 1, there being peripherally extending lands at the circumferential surface of the wheel, each land being disposed between two circumferentially extending recesses.

4. The apparatus in accordance with claim 3, wherein said lands have widths of 1 mm or less.

5. The apparatus in accordance with claim 1, wherein the metal strands have the form of ribbons having a width of 200 μm or less.

6. The apparatus in accordance with claim 1, wherein the metal strands have a thickness of 50 μm or less.

7. The apparatus in accordance with claim 1, wherein the metal strands have at least one transverse dimension of 50 μm or less and a length at least ten times greater than said at least one transverse dimension.

8. The apparatus in accordance with claim 1, wherein the rotatable wheel is temperature controlled.

9. The apparatus in accordance with claim 1, wherein the wheel is made of one of a metal, a metal alloy, a ceramic material and graphite or is a wheel of a base material having a layer or type made of one of a metal, a metal alloy, a ceramic material, graphite and a vapour deposited carbon; and/or wherein said wheel is mounted to rotate within the chamber having the atmosphere, the atmosphere being at least one of air and an inert gas.

10. The apparatus in accordance with claim 1, wherein a deflector is provided upstream of the nozzle in the direction of rotation of the wheel to deflect boundary layer gas from the circumferentially extending surface prior to depositing molten metal on the surface via the nozzle.

11. The apparatus in accordance with claim 1, wherein the gas pressure applied to the molten metal is selected in the range from 50 mbar to 1 bar overpressure relative to a pressure external to the nozzle.

12. The apparatus in accordance with claim 1, wherein a motor is adapted to drive the wheel at a frequency of greater than 85 Hz for a copper wheel having a diameter of 200 mm.

13. The apparatus in accordance with claim 1, wherein the circumferential surface of the wheel has transversely extending features to control the length of the strands produced.

14. The apparatus in accordance with claim 1, wherein the material of the wheel is selected so that it does not readily bond to the molten metal.

15. A method for producing elongate strands of metal having at least one transverse dimension of 50 μm or less and a length at least ten times greater than said at least one transverse dimension, the method comprising the steps of directing a molten metal through a nozzle having a rectangular cross-section with a width of a nozzle opening in a circumferential direction of rotation of a rotating wheel and a length transverse to a circumferential surface of the rotating wheel which is greater than the width onto the circumferential surface of the rotating wheel, by applying a gas pressure to the molten metal to move it through the nozzle opening and deliver it to the circumferential surface of the rotating wheel, providing the circumferential surface of the rotating wheel with circumferentially extending edges and recesses formed between or bounded by the edges and collecting solidified strands of metal formed on the circumferential surface from the molten metal and separated from the circumferential surface by centrifugal force generated by rotation of the rotating wheel, the method further comprising the steps of controlling the width of the nozzle opening, controlling the gas pressure applied to the molten metal to move it through the nozzle opening and deliver it to the circumferential surface of the rotating wheel and controlling a speed of rotation of the rotating wheel to reduce a flow of molten metal onto the circumferential surface of the rotating wheel to a level at which it is concentrated by the forces that are acting at said circumferentially extending edges and recesses formed between or bounded by the edges and using these edges to concentrate the molten metal at the edges to produce the desired elongate strands of metal, the nozzle opening having a width of between 10 μm to 100 μm and wherein the rotating wheel is mounted and configured to rotate within a chamber having an atmosphere at a higher pressure than ambient pressure.

16. The method in accordance with claim 15, wherein the flow of molten metal is reduced to a level at which the elongated strands have a width of 200 μm to 1 μm.

17. The method in accordance with claim 15, wherein the metal strands have a thickness of 50 μm to 1 μm.

* * * * *